US009395100B2

(12) United States Patent
Crowe et al.

(10) Patent No.: US 9,395,100 B2
(45) Date of Patent: Jul. 19, 2016

(54) LOW AIR RESISTANCE INFRARED HEATING SYSTEM AND METHOD

(71) Applicant: Twin-Star International, Inc., Delray Beach, FL (US)

(72) Inventors: Matthew Crowe, Chelsea (CA); Jianmin Huang, Dongguan (CN)

(73) Assignee: TWIN-STAR INTERNATIONAL, INC., Delray Beach, FL (US)

( * ) Notice: Subject to any disclaimer, the term of this patent is extended or adjusted under 35 U.S.C. 154(b) by 444 days.

(21) Appl. No.: 13/707,382

(22) Filed: Dec. 6, 2012

(65) Prior Publication Data

US 2014/0161426 A1 Jun. 12, 2014

(51) Int. Cl.

| | |
|---|---|
| ***F24D 15/02*** | (2006.01) |
| ***F24F 1/04*** | (2011.01) |
| ***F24H 3/02*** | (2006.01) |
| ***F24H 3/04*** | (2006.01) |
| ***F24H 9/00*** | (2006.01) |

(52) U.S. Cl.
CPC ..... *F24H 3/0417* (2013.01); *F24H 9/0063* (2013.01)

(58) Field of Classification Search
None
See application file for complete search history.

(56) References Cited

U.S. PATENT DOCUMENTS

| | | | | | |
|---|---|---|---|---|---|
| 1,444,621 | A | * | 2/1923 | Lynn et al. | 392/374 |
| 1,694,351 | A | * | 12/1928 | Long | 392/383 |
| 2,527,013 | A | * | 10/1950 | Kjelgaard | 392/356 |
| 2,919,338 | A | * | 12/1959 | Covault et al. | 392/356 |
| 3,180,972 | A | * | 4/1965 | Covault | 392/356 |
| 3,575,582 | A | * | 4/1971 | Covault | 392/356 |
| 3,765,475 | A | * | 10/1973 | Hooper | 165/267 |
| 3,973,101 | A | * | 8/1976 | Bosse | 392/369 |
| 4,053,732 | A | * | 10/1977 | Carter | 392/358 |
| 4,223,205 | A | * | 9/1980 | Sturgis | 392/358 |
| 4,309,594 | A | * | 1/1982 | Jones | 392/356 |
| 4,362,922 | A | * | 12/1982 | Anderson | 392/368 |
| 4,549,072 | A | * | 10/1985 | Brist et al. | 219/400 |
| 4,680,448 | A | * | 7/1987 | Fester | 392/356 |
| 4,782,601 | A | * | 11/1988 | Gonzalez | 34/233 |
| 5,334,818 | A | * | 8/1994 | Edwards et al. | 219/539 |
| 5,696,872 | A | * | 12/1997 | Seward | 392/341 |
| 6,327,427 | B1 | * | 12/2001 | Burkett | 392/369 |
| 6,795,643 | B2 | * | 9/2004 | Ito et al. | 392/307 |
| 7,046,918 | B1 | * | 5/2006 | Burkett et al. | 392/375 |
| 7,190,887 | B1 | * | 3/2007 | Compton | 392/365 |
| 8,541,721 | B2 | * | 9/2013 | Moskal et al. | 219/520 |
| 8,655,159 | B2 | * | 2/2014 | Tai et al. | 392/360 |
| 2004/0197091 | A1 | * | 10/2004 | Orr et al. | 392/365 |
| 2004/0218912 | A1 | * | 11/2004 | Shapiro et al. | 392/365 |
| 2007/0023411 | A1 | * | 2/2007 | Angelis et al. | 219/202 |

* cited by examiner

*Primary Examiner* — Thor Campbell
(74) *Attorney, Agent, or Firm* — Johnson & Martin, P.A.; James David Johnson

(57) ABSTRACT

A heating air circulation system with blades to move a gas in a flow direction, an infrared heating element located near the blades, and a heat exchanger located near the infrared heating element to direct the gas without substantially affecting a flow pattern of the gas. The system is selectable between heating and non-heating operation. An enclosure may be included with an inlet and outlet. The heat exchanger may be at least partially tapered. The blades may be curved and included in a crossflow fan.

20 Claims, 9 Drawing Sheets

LOW AIR RESISTANCE INFRARED HEATING SYSTEM AND METHOD

FIELD OF THE INVENTION

The invention relates to heating systems. More particularly, the invention relates to infrared heating system that uses moving air.

BACKGROUND

Heating systems exist in the present market to increase the temperature of a given space. Some of these heating systems include a radiator, which may or may not be filled with a fluid, to transfer heat to a space using convection. However, such systems are incapable or vastly inefficient for being used to move air within the space.

Many other systems combine resistive heating elements and a fan to heat a space. These space heaters use resistance heating wire, such as nichrome (NiCr) or ceramic heating elements (Positive Thermal Coefficient ceramic heaters) to create heat and force air through these elements to transfer heat to the air that will be expelled by the heater.

Resistive heating systems, such as those using NiCr and PTC elements, have a high density of heating elements, which inhibits fan function and air speed. The high density of resistive heating elements is very detrimental to air flow, slowing air speed and total volume of air output (Cubic Feet per Minute, CFM.). In order to increase the air output of the fan heaters with these dense heating elements, the fan speed and output would need to be increased greatly, problematically causing the heating system to be undesirably noisy.

Due to the increased effort required by the fan to pass air through heating elements of the heating system in the prior art, most consumers find it impractical to operate such system as fans when no heating is desired. In fact, due in part to these limitations, many of the heating system in the prior art do not even provide non-heating operation.

What is needed is efficient heating system that can move a gas, such as air, with high efficiency across one or more heating elements. What is also needed is the ability to incorporate the system with a fan such that the heating system may be used efficiently for heating and non-heating operation.

SUMMARY

According to embodiments of the present invention, an infrared heating system is described that may efficiently move a gas, such as air, across one or more heating elements. The system of the present invention may also be incorporated into a system with a fan such that it may be used efficiently for heating and non-heating operation.

Accordingly, the invention features a heating system that includes blades to move a gas in a flow direction, the blades being rotatably repositionable; an infrared heating element located near the blades, the gas flowing in the flow direction passing by at least part of the infrared heating element; and a heat exchanger located near the infrared heating element to direct the gas to direct a flow pattern of the gas. The infrared heating element can be selectable between heating and non-heating operation. The heat exchanger can increase flow characteristics of the gas passed by the infrared heating element.

In another aspect, the invention can feature the heat exchanger being located approximately between the blades and the infrared heating element.

In another aspect, the invention can feature an array of the infrared heating element and the heat exchanger, at least part of the array being positioned substantially linearly, wherein the array is located near the blades to minimize disruption of the flow pattern, wherein a plurality of infrared heating elements is includable in the array, and wherein a plurality of heat exchangers is includable in the array.

In another aspect, the invention can feature a group of arrays, each array in the group being locatable substantially parallel to each other.

In another aspect, the invention can feature an enclosure with an inlet and outlet, wherein the infrared heating element and the heat exchanger are located between the blades and the outlet, wherein the gas enters the enclosure through the inlet to be received by the blades, and wherein the gas is moved by the blades to flow in the flow direction to exit the enclosure through the outlet.

In another aspect, the invention can feature the enclosure being constructed at least partially of wood.

In another aspect, the invention can feature the heat exchanger being at least partially tapered.

In another aspect, the invention can feature the heat exchanger including a plurality of elongated lengths running approximately parallel with the flow direction, wherein the infrared heating element is located between the plurality of elongated lengths.

In another aspect, the invention can feature the blades being curved and included in an impeller, the impeller being includable in a crossflow fan.

In another aspect, the invention can feature the gas being movable in the flow direction with a velocity of at least about three meters per second and a volume of at least about 150 cubic feet per minute.

The invention can also feature an air circulating heater system that includes one or more blades to move a gas in a flow direction, the blades being rotatably repositionable; an infrared heating element located near the blades, the gas flowing in the flow direction passing by at least part of the infrared heating element; and a heat exchanger located approximately linearly between the blades and the infrared heating element in an array, the heat exchanger being at least partially tapered to direct the gas to minimize disruption of a flow pattern of the gas. A plurality of infrared heating elements can be includable in the array. A plurality of heat exchangers can also be included in the array. The heat exchanger can increase flow characteristics of the gas passed by the infrared heating element. The infrared heating element can be selectable between heating and non-heating operation.

In another aspect, the invention can feature a group of arrays, each array in the group being locatable substantially parallel to each other.

In another aspect, the invention can feature an enclosure with an inlet and outlet, wherein the array is located between the blades and the outlet, wherein the gas enters the enclosure through the inlet to be received by the blades, and wherein the gas is moved by the blades to flow in the flow direction to exit the enclosure through the outlet.

In another aspect, the invention can feature the enclosure being constructed at least partially of wood.

In another aspect, the invention can feature the blades being curved and included in an impeller, the impeller being includable in a crossflow fan.

In another aspect, the invention can feature the gas being movable in the flow direction with a velocity of at least three meters per second and a volume of at least 150 cubic feet per minute.

A method is provided for operating a heating system with high efficacy, wherein the system includes blades, an infrared heating element being selectable between heating and non-heating operation, and a heat exchanger located near the infrared heating element, and the method includes the steps of: (a) moving a gas in a flow direction by rotating the blades; (b) directing the gas using the heat exchanger to minimize disruption of a flow pattern of the gas; and (c) passing the gas across the infrared heating element located near the heat exchanger with high flow characteristics, the gas being controllably heated by the infrared heating element.

Another method of the invention can feature the system further including an enclosure with an inlet and outlet and the method further including the steps of: (d) receiving the gas by the blades enclosure through the inlet; and (e) moving the gas using the blades to flow in the flow direction across the infrared heating element and the heat exchanger to exit the enclosure through the outlet.

Another method of the invention can feature an array of the infrared heating element and the heat exchanger positioned substantially linearly, the array being located near the blades to minimize disruption of the flow pattern; wherein a plurality of infrared heating elements is includable in the array; and wherein a plurality of heat exchangers is includable in the array.

Another method of the invention can feature the system including a group of arrays, each array in the group being locatable substantially parallel to each other.

Another method of the invention can feature the blades being curved and included in an impeller, the impeller being includable in a crossflow fan.

Another method of the invention can feature the step of: (f) moving the gas in the flow direction with a velocity of at least about three meters per second and a volume of at least about 150 cubic feet per minute.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
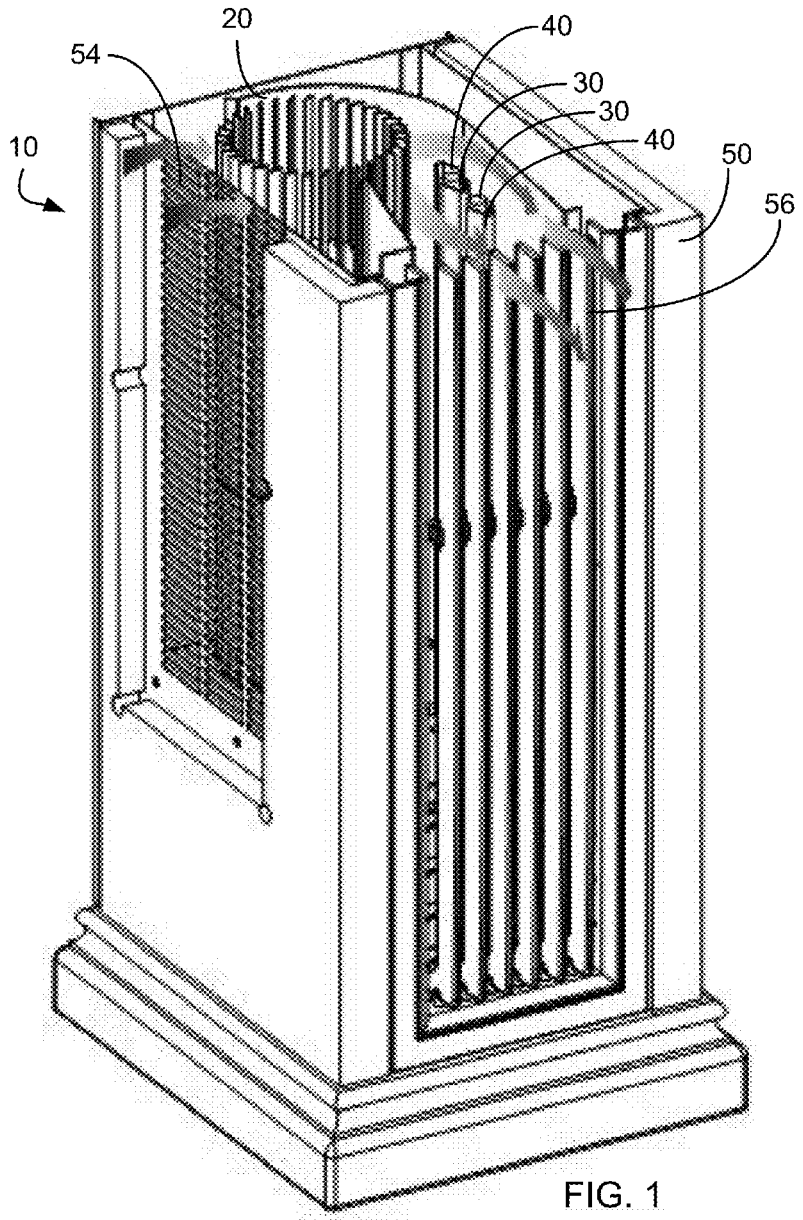
FIG. 1 is a perspective view of a heating system, according to an embodiment of the present invention.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more"

to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system 10 having at least one of A, B, and C" would include but not be limited to systems 10 that have A alone, B alone, C alone, A and B together, A and C together, B and C together, and/or A, B, and C together, etc.). In those instances where a convention analogous to "at least one of A, B, or C" is used, in general such a construction is intended in the sense one having skill in the art would understand the convention (e.g., "a system 10 having at least one of A, B, or C" would include but not be limited to systems 10 that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

The present invention will now be described in detail with reference to embodiments thereof as illustrated in the accompanying drawings. In the following description, a heating system will be discussed. Those of skill in the art will appreciate alternative labeling of the heating system as a heater, heating fan, system, the invention, or other similar names. Skilled readers should not view the inclusion of any alternative labels as limiting in any way. Additionally, in the interest of clarity, the following disclosure will discuss moving air. However, skilled artisans will appreciate that the system may move any type of gaseous fluid, and should not be limited solely to air.

Referring now to FIG. 1, the heating system 10 will be described generally. The features disclosed generally will be described in greater detail throughout this disclosure. The heating system 10 may include a number of blades 20 that may form a fan. The blades 20 may be located in an enclosure 50, which may have an inlet 54 and outlet 58. Air may be moved across one or more infrared heating element 30. One or more heat exchanger 40 may be located near a heating element 30, which may improve heat dissipation and air flow characteristics.

Figure 2:
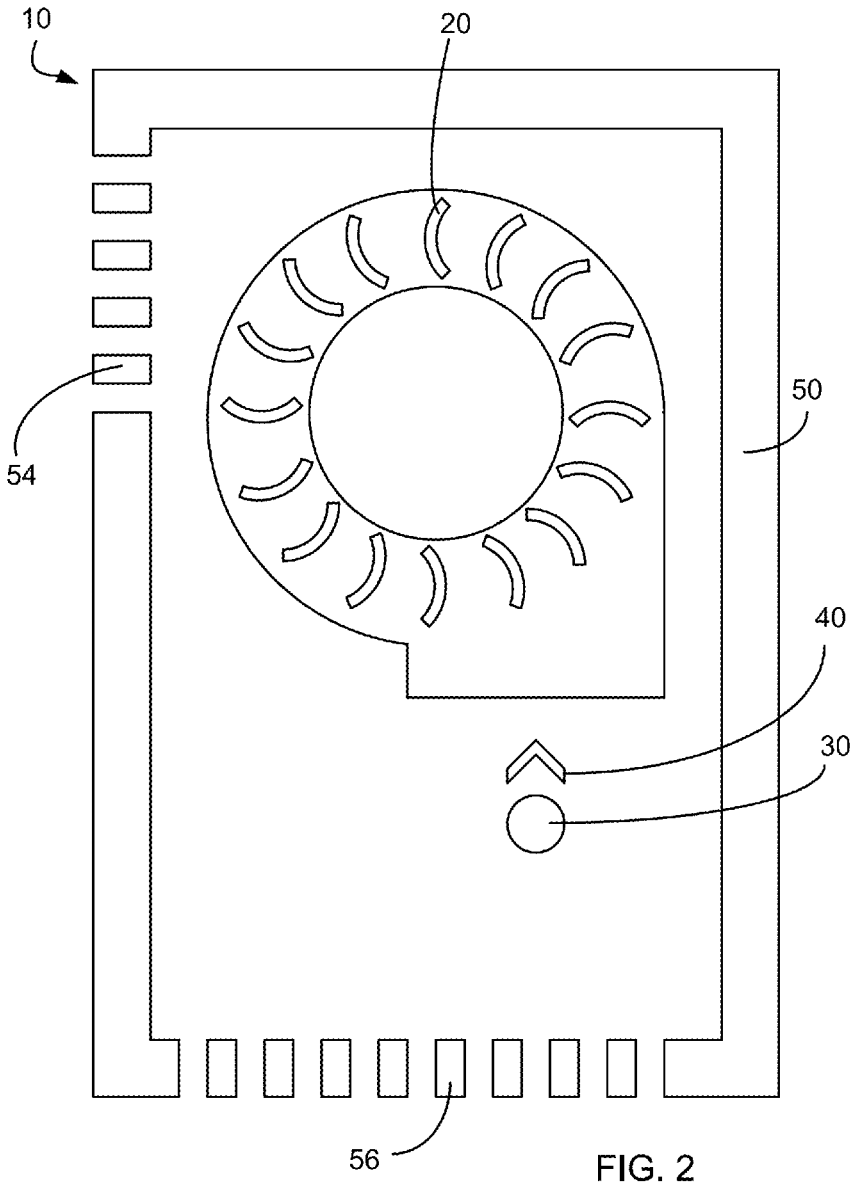
FIG. 2 is a schematic drawing of a heating system, according to an embodiment of the present invention.

Referring additionally to FIG. 2, the blades 20 will now be discussed in more detail. The blades 20 may be include as a component of a mechanical fan. A number of blades 20 may be arranged to move air as the blades 20 are rotated about an axis. In an embodiment of the present invention, the blades 20 may be arranged in an impeller, which may be included in a crossflow fan structure. However, those of skill in the art will appreciate alternative blade 20 configurations may be used without limitation, such as axial, centrifugal, coanda, convective, electrostatic, or other fan types.

In the interest of clarity, an embodiment that includes a crossflow fan will be discussed in greater detail. A crossflow fan includes an impeller of blades 20 positioned about a center axis. The blades 20 of the impeller are typically long, such that the impeller may be rotated about a vertical axis. The blades 20 may have a forward curved shape. The impeller may be placed in a housing 24, which may assist in determining the flow direction of the air moved by the fan. As the impeller may rotate in the housing 24, air may move transversely across the impeller.

Figure 3:
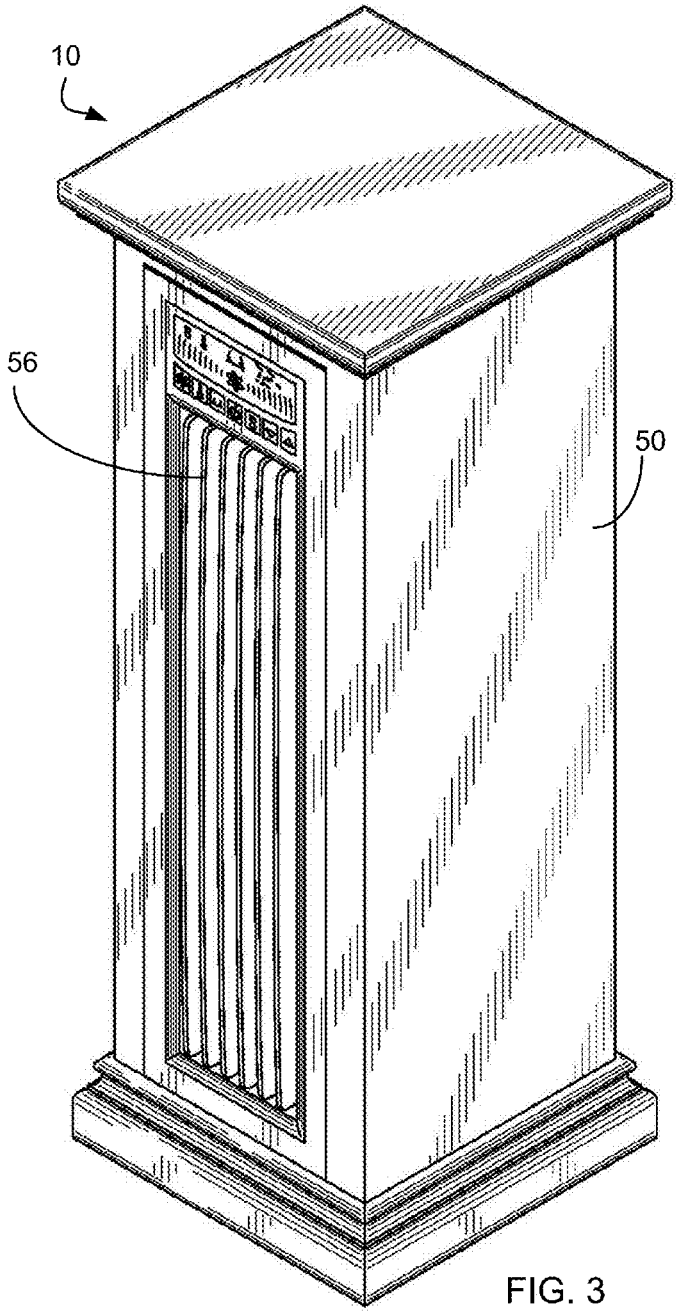
FIG. 3 is a perspective view of an enclosure, according to an embodiment of the present invention.

The blades 20, which may be included in an impeller and located within a housing 24, may be located within an enclosure 50. The enclosure 50 may include a number of walls, which at least partially enclose a shape. In an example wherein a crossflow fan is used, the enclosure 50 may be structure with an approximately rectangular base. The enclosure may extend vertically for a height taller than the length of the base, as illustrated in FIG. 3. However, those of skill in the art will appreciate that an enclosure 50 may be of virtually any shape, and may be designed to accommodate fan types other than a crossflow fan. The enclosure 50 may be constructed of virtually any material that can withstand a moderate amount of heat. In one embodiment, the enclosure 50 may be constructed at least partially using wood.

The enclosure 50 may include an inlet 54 and outlet 58, through which air may pass. The inlet 54 may be positioned such that the blades 20 may draw air from outside the enclosure 50 through the inlet 54. Additionally, the outlet 58 may be positioned such that air may be moved from the blades 20 to pass across the heat exchanger 40 and infrared heating element 30 before the air is exhausted through the outlet 58. Additional embodiments may include one or more inlet 54, and one or more outlet 58.

Referring back to FIGS. 1-2, an infrared heating element 30 may be included in the heating system 10. The infrared heating system 10 may be positioned such that air moved by the blades 20 pass across the infrared heating element 30. If the system 10 is in heating operation, heat may be transferred from the infrared heating element 30 to the air. The heated air may then be used to heat a space, such as a room.

An infrared heating element 30 may be desirable due to the properties of the heat radiated from the elements. An infrared heating element 30 may transfer energy from a high temperature body to a low temperature body through electromagnetic radiation. As materials within the infrared heating element 30 are excited, they may emit infrared radiation of varying bands. As an example, infrared emitters may emit radiated energy with a range of at least 3000 nanometers.

Examples of infrared heating elements 30 will now be discussed. Those of skill in the art will appreciate that the following examples are provided only as examples, and should not be viewed to limit the present invention in any way. The infrared heating element 30 may be constructed using a glass tube, which may be highly purified. The glass tube may be formed using quartz, due to properties of quartz that radiate infrared heat at high temperatures without melting. A wire or element may be included in the glass tube. More specifically, provided in the interest of clarity and without limitation, a tungsten wire, nichrome (NiCr) wire, halogen element, and/or carbon fiber element may be included in the glass tube.

A heat exchanger 40 may be located near the infrared heating element 30. As illustrated in FIG. 2, the heat exchanger 40 may be located between the blades 20 and the infrared heating element 30. The heat exchanger 40 may be shaped to direct air moved by the blades 20 around the infrared heating element 30 with a decreased impact on flow pattern of the air.

The heat exchanger 40 may be constructed of a material that at least partially absorbs heat emitted by the infrared heating element 30. The heat exchanger 40 may increase efficiency of the system 10 during heating and non-heating operation. During heating operation, air is passed across the heat exchanger 40. At least part of the heat absorbed by the heat exchanger 40 from the infrared heating element 30 may be transferred to the air. Additional heat may be transferred to the air as it passes the infrared heating element 30.

During heating and non-heating operation, the heat exchanger 40 may help to direct the air to maintain an efficient flow pattern. As the air may contact the front of the heat exchanger 40, its flow may be directed around the heat exchanger 40 and subsequently located infrared heating elements 30. The front of the heat exchanger 40 may be at least partially pointed or tapered, which may, in essence, split the flow pattern of the air. The air may then efficiently pass the heat exchanger 40 and infrared heating elements 30 incurring minimal disruptive flow patterns. The air may still contact the heat exchanger 40 and infrared heating element 30, which may transfer heat to the air during heating operation.

Figure 4:
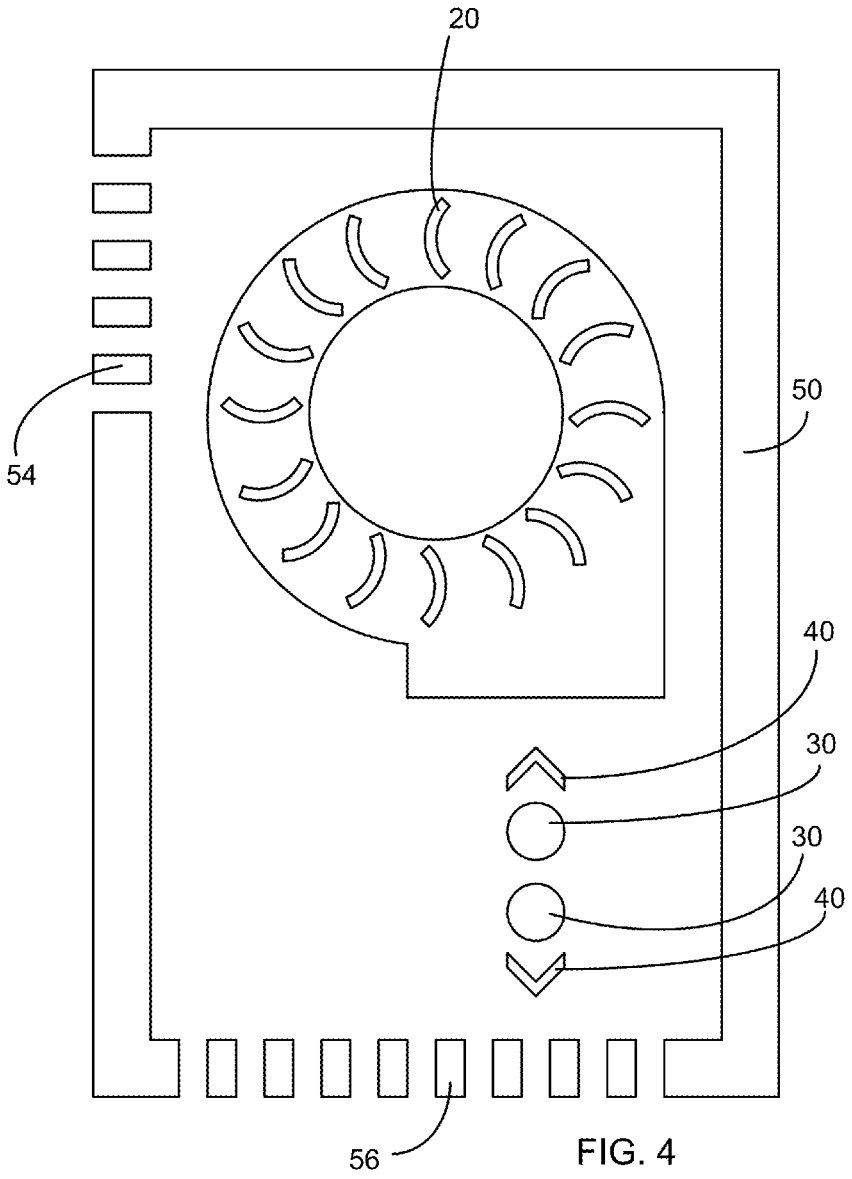
FIGS. 4-8 are schematic drawings of additional embodiments of the heating system of FIG. 2.

Additional infrared heating elements 30 and/or heat exchangers 40 may be included in the heating system 10. An embodiment with multiple infrared heating element 30 and heat exchangers 40 is illustrated in FIG. 4, which will now be discussed. In this embodiment, two infrared heating elements 30 are included. The infrared heating elements 30 are aligned linearly in an array, such that the air may pass across the infrared heating elements 30 with minimal resistance. Skilled artisans will appreciate additional configurations of the infrared heating elements 30.

Heat exchangers 40 may be located at the front and back ends of the array of linearly located infrared heating elements 30. The front and rear heat exchanger 40 may include an at least partially pointed end. For the front heat exchanger 40, the pointed end may face the blades 20, such to receive and direct the air from the blades 20 with a minimal negative affect on its flow pattern. The rear heat exchanger 40 may be oriented to point in an approximately opposite direction from the front heat exchanger 40. More specifically, the pointed end of the rear heat exchanger 40 may point away from the blades 20. With this orientation, the rear heat exchanger 40 of the array may cause to the passing air to flow with minimal disruption to flow patters, for example, by reducing the creation of velocity inhibiting vortices.

As illustrated in FIG. 4, a linear configuration of heat exchangers 40 and infrared heating elements 30 may be desirable to provide maximum aerodynamic properties, which would provide for minimal disruption in the flow pattern of passing air. Skilled artisans will appreciate additional configurations, which may not necessarily include linearly aligned components.

Figure 5:
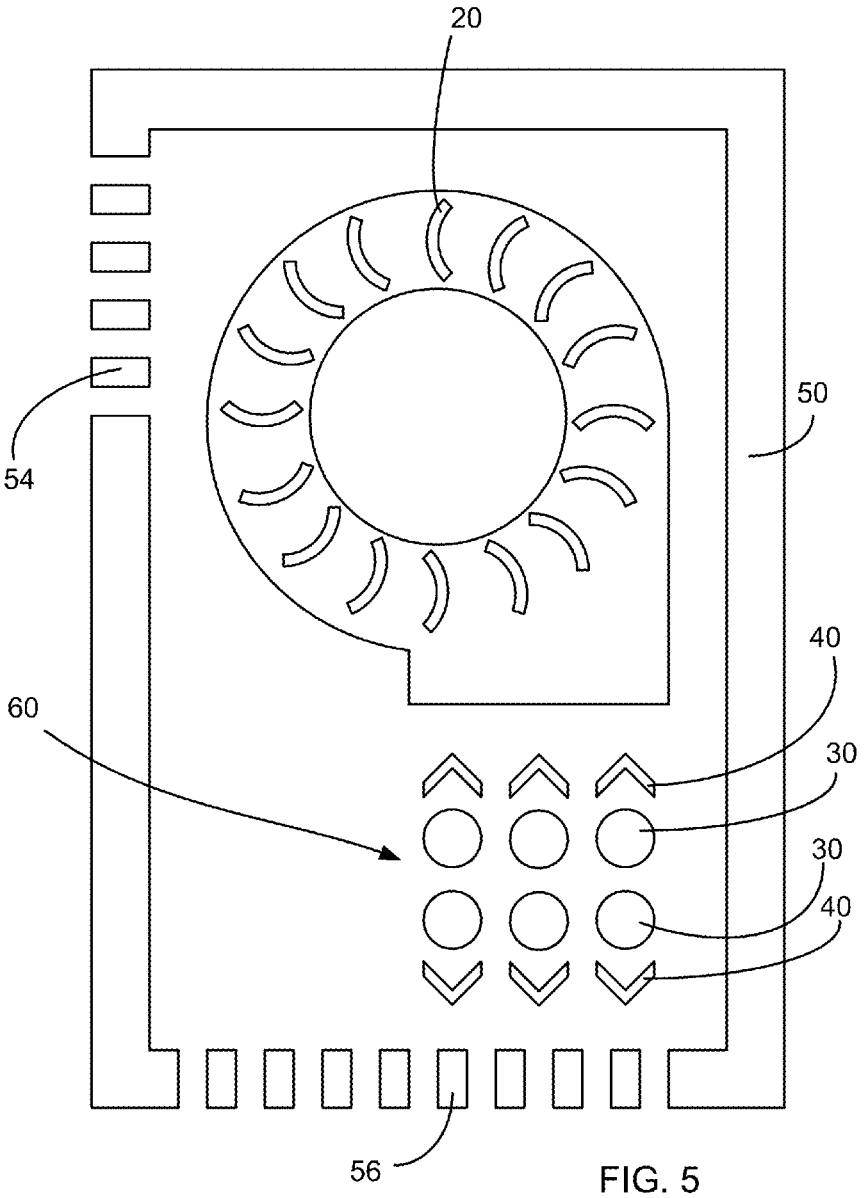

Referring now to FIG. 5, an embodiment of the system 10 with group 60 of arrays, each array having heat exchangers 40 and infrared heating elements 30 will now be discussed. As illustrated in FIG. 5, a plurality of infrared heating elements 30 and heat exchangers 40 may be included in the system 10, for example, to increase the amount of heat producible by the system 10 and thus transferrable to the air. As discussed above, infrared heating elements 30 and heat exchangers 40 may be grouped linearly in an array. A number of arrays may be positioned near one another, creating a group 60. The each array of components within the group 60 may be aligned substantially parallel to one another. Additionally, each array of components may be located an approximately equal distance from the blades 20. As the air may flow from the blades across the group 60, the flow pattern of the air may be shaped to minimize aerodynamic inefficiencies and velocity inhibiting vortices. Skilled artisans will appreciate additional configurations by which heat exchangers 40 and infrared heating elements 30 may be aligned within an array and/or group 60.

Figure 6:
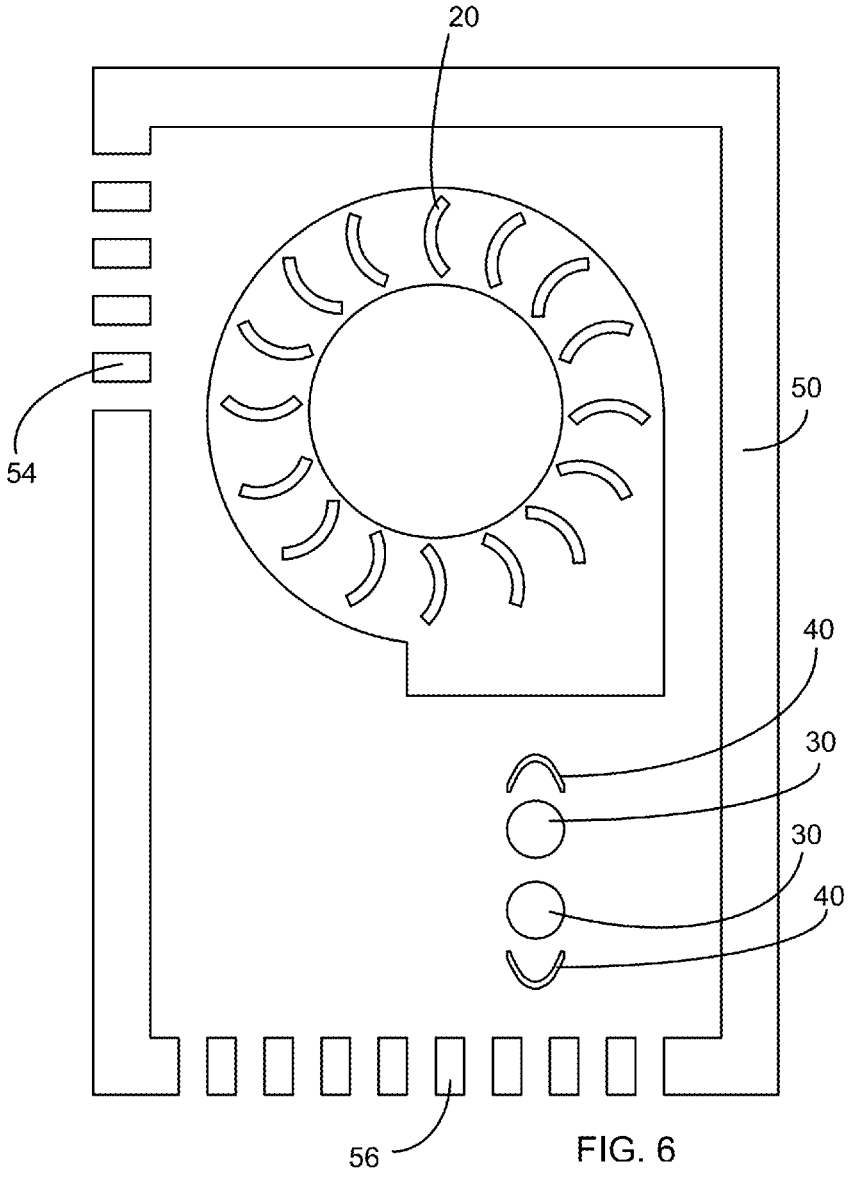

Referring now to FIG. 6, an embodiment of the system 10 with alternatively shaped heat exchangers 40 will now be discussed. Skilled artisans should appreciate that although FIG. 6 illustrates a group 60 of infrared heating elements 30 and heat exchangers 40, which may be included arrays, the alternatively shaped heat exchanger 40 may also be used in an embodiment of the system 10 with one heat exchanger 40 and one infrared heating element 30. As illustrated, the heat exchanger 40 may include a pointed or tapered end that is partially rounded. The rounded end may provide aerodynamic characteristics that differ from an otherwise pointed end, which may be desirable for various applications of the system 10. For example, the rounded end of the heat exchanger 40 may be shaped as a wing, for example, of an aircraft. The wing shape may provide improved flow characteristics, which may be decrease the effect of the heat exchanger 40 on the flow pattern of passing air.

Figure 7:
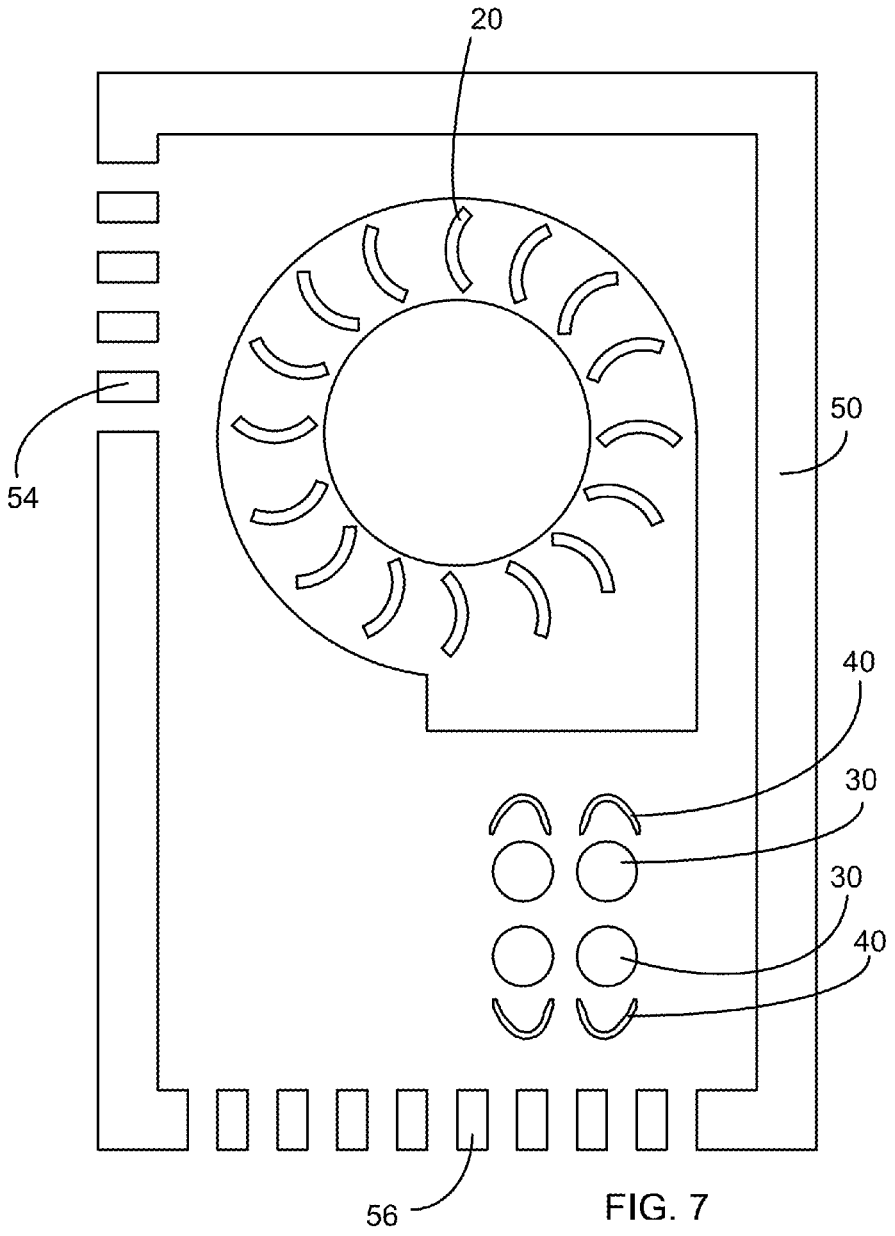

Referring now to FIG. 7, an embodiment of the system 10 with at least one array of alternatively shaped heat exchangers 40 will now be discussed. The arrays may be included in a group 60. In the group 60, a plurality of heat exchangers 40 may be located near infrared heating elements 30. One or more of the heat exchangers 40 in the group 60 of the present embodiment may have shapes and orientations that differ from the other heat exchangers 40 in the group 60. By including heat exchangers 40 of various shapes and orientations, the rate at which the air may pass the heat exchangers 40 and infrared heating elements 30 may be increased.

Figure 8:
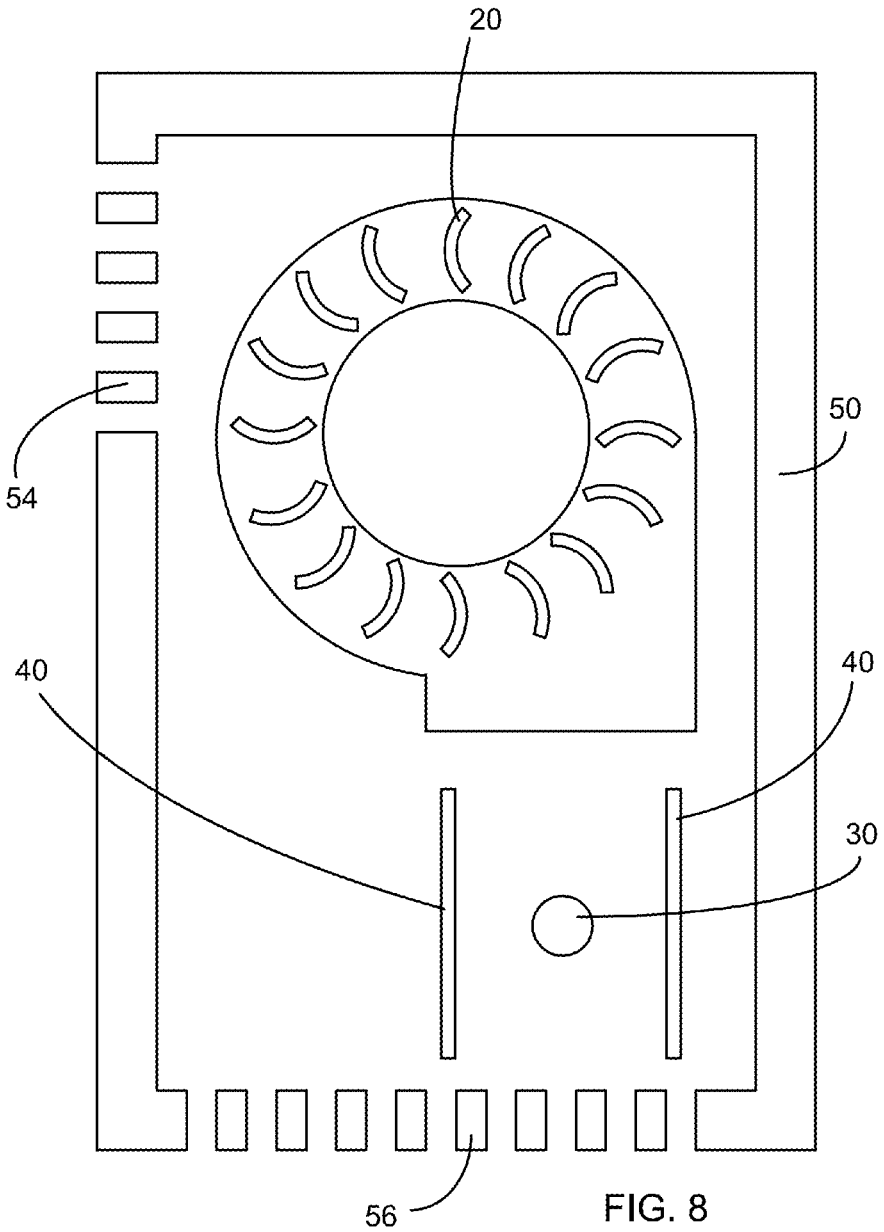

Referring now to FIG. 8, an embodiment of the system 10 with alternatively configured heat exchangers 40 will now be discussed. The system 10 may include one or more heat exchanger 40 as an elongated member that runs a length along the flow direction. Two thin elongated members are illustrated in FIG. 8 to run substantially parallel with the flow direction. However, skilled artisans will appreciate additional configurations with differing numbers and configurations of elongated heat exchangers 40.

In this embodiment, an infrared heating element 30 may be included between the elongated heat exchangers 40. In some configurations, there may be no pointed, rounded, or similarly shaped heat exchanger 40 located adjacent to the infrared heating element 30. However, other configurations may include one or more rounded, pointed, or similarly shaped heat exchanger 40 adjacent to the infrared heating element 30. Additional configurations may include an array or group 60 within the elongated heat exchangers 40.

In operation, the system 10 may move air using included blades 20 and optionally heat the air using the infrared heating element 30 and/or heat exchanger 40. More specifically, the system 10 may be selected to operate in non-heating operation or heating operation. During non-heating operation, the infrared heating elements 30 may generate approximately no heat. In this operation, passing air would not undergo a significant temperature change. In non-heating operation, the system may operate substantially as a fan.

During the heating operation, the infrared heating elements 30 generate heat, which may be transferred to the heat exchanger 40 and/or passing air. More specifically, one or more infrared heating elements 30 used to generate heat may also transfer heat directly to passing air. Additionally, heat that has been transferred to the heat exchanger 40 may also be subsequently transferred to passing air. The amount of heat generated by the infrared heating elements 30 may be adjustable, for example, by manipulating a control panel.

Figure 9:
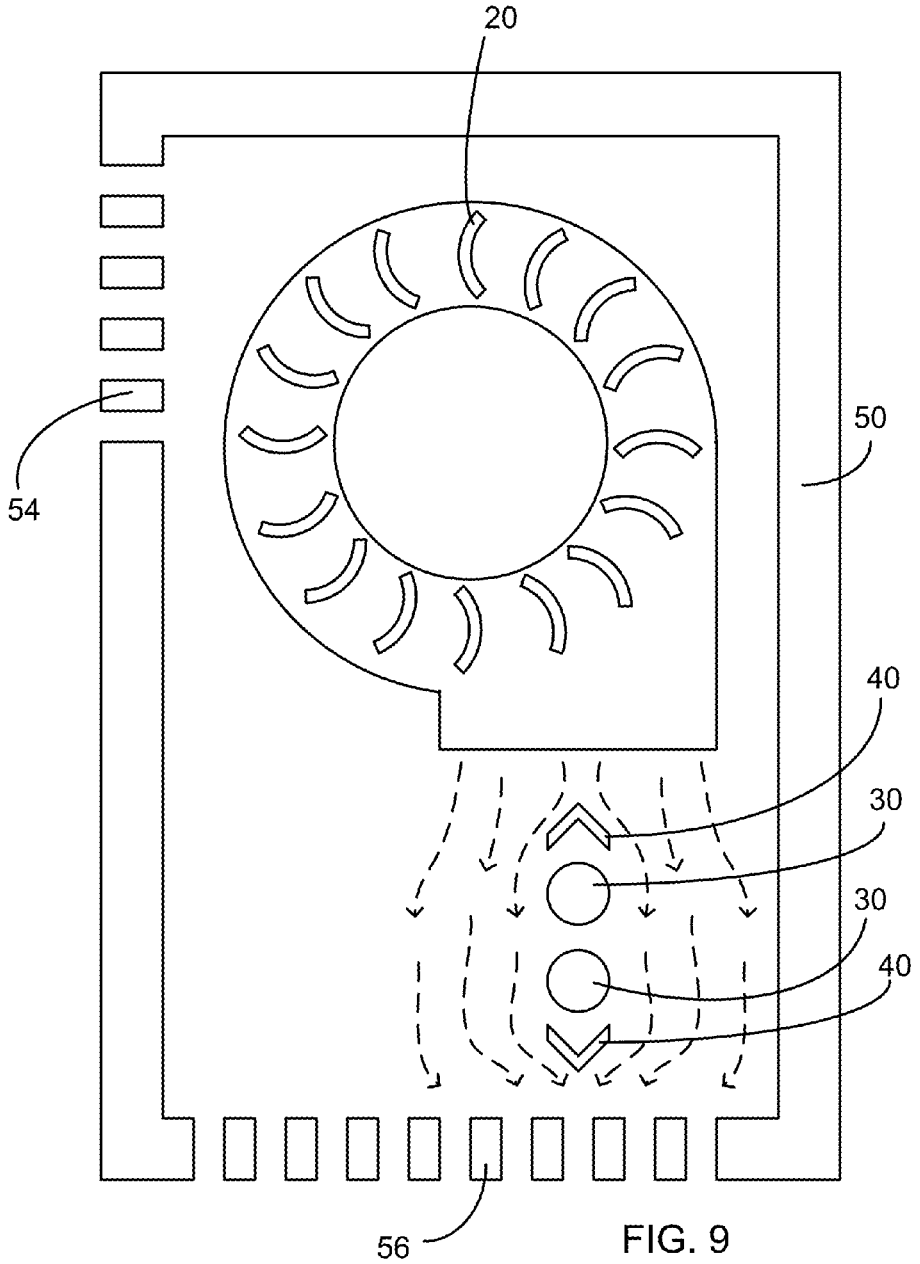
FIG. 9 is a schematic drawing illustrating flow patterns of air, according to an embodiment of the present invention.

Referring now to FIGS. 1, 4, and 9, an illustrative flow pattern is discussed. Skilled artisans will appreciate that the flow pattern discussed below has been provided in the interest of clarity, and is not intended to limit the invention in any way. The blades 20 of the system 10 may be rotated. As the blades 20 rotate, air may be drawn into the heating system 10 through the inlet 54 and moved toward the outlet 58.

The moving air may pass any number of infrared heating elements 30 and heat exchangers 40, which may or may not be configured in an array. As mentioned above, a heat exchanger 40 located closest to the blades 20 may include a pointed end facing the blades 20. As the air meets the pointed or tapered end of the heat exchanger 40, the air may be directed to either side of the heat exchanger 40. The air may be directed by the heat exchanger with a minimal negative affect on the flow pattern of the air.

An illustrative flow direction of air during operation of the heating system 10 is shown in FIG. 9, which includes one linear configuration of heat exchangers 40 and infrared heating elements 30. Skilled artisans should appreciate that the illustration of one linear configuration has been used to help provide a clear discussion, and is not intended to impose any limitation.

As the air encounters the pointed end of the heat exchanger 40, it may be essentially split into two channels that pass the infrared heating elements 30 on each side. Splitting the air into multiple channels minimizes the occurrence of vortices, allowing the flow pattern of the air to continue with minimal disturbance to the velocity of the moving air. As part of the air may contact the heat exchanger 40 during heating operation, at least some heat may be transferred from the heat exchanger 40 to the air by conduction or convection.

After passing the heat exchanger 40, the air may pass one or more infrared heat exchangers 40. During heating operation, this air may be heated by the infrared heating elements 30 via infrared radiation, convection, and/or conduction.

The flow pattern for at least part of the air may be shaped to contact or flow between the infrared heating elements 30. However, the majority of air passing the infrared heating elements 30 may continue to flow in an optimized pattern, providing air flow at a high velocity, helping the system to move a high volume of air. The passing air may also be heated by the infrared heating elements 30 via infrared radiation, convection, and/or conduction.

Having passed the infrared heating elements 30, the air may then pass another heat exchanger 40, which may be located at a terminal position in the linear configuration. This heat exchanger 40 may be use to at least partially recombine the channels of air, which may have been separated by the heat exchanger 40 located at the front of the linear configuration. The heat exchanger 40 at the terminal position may be oriented opposite the heat exchanger 40 at the front position, for example, rotated approximately 180 degrees. Recombining the air flow pattern into an approximately single channel from multiple channels minimizes the occurrence of vortices, allowing the flow pattern of the air to continue without significant disturbances to the velocity of the moving air. During heating operation, as part of the air may contact the heat exchanger 40, at least some heat may be transferred from the heat exchanger 40 to the air by conduction or convection. The air may then exit the system 10 through the outlet 58.

The following illustrative technical information is provided below in the interest of clarifying advantages of the present invention, is not intended to limit the present invention to the information below. In trials of the present invention, an embodiment of the present invention was created using a crossflow fan capable of 246 CFM in an isolated environment. The fan was placed within an enclosure 50 including a configuration of heat exchangers 40 and infrared heating elements 30 discussed above. The illustrative system 10 achieved an average air speed of 3.3 meters/second, with a maximum air speed reaching 5.1 meters/second. During this operation, the system 10 was able to produce approximately 165 CFM at high level speed. Those of skill in the art will appreciate additional configurations may produce differing results, which may have values at, below, or above this illustrative technical information.

The heating system 10 with improved air flow configurations described by this disclosure may be used to heat a space with high efficiency. During heating operation, the heating system 10 advantageously heats a space with lower noise output than the heating devices of the prior art. During non-heating operation, the system 10 beneficially moves a sufficient velocity of air remain useful as a fan. The combination of effective heating capability and high air flow characteristics provide a user with an air circulation and heating system 10 that can be efficiently used in heating and non-heating operation.

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A heating system comprising:

blades to move a gas in a flow direction, the blades being rotatably repositionable;

an infrared heating element located near the blades, the gas flowing in the flow direction passing by at least part of the infrared heating element, wherein the infrared heating element comprises a tube within which a wire or element may be positioned; and at least a first heat exchanger positioned in a location in the flow direction between the blades and the infrared heating element to direct a flow pattern of the gas;

wherein the infrared heating element is selectable between heating and non-heating operation;

wherein the at least first heat exchanger comprises a tapered front oriented toward the blades to increase flow characteristics of the gas passed by the infrared heating element.

2. The system of claim 1, wherein the front of the at least first heat exchanger is pointed or partially rounded and is located approximately between the blades and the infrared heating element.

3. The system of claim 1, further comprising an array comprised of the infrared heating element and the at least first heat exchanger, at least part of the array being positioned substantially linearly, wherein the array is located near the blades to minimize disruption of the flow pattern, wherein a plurality of infrared heating elements is includable in the array, and wherein a plurality of heat exchangers is includable in the array.

4. The system of claim 3 comprising a group of arrays, each array in the group being locatable substantially parallel to each other.

5. The system of claim 1, further comprising an enclosure with an inlet and outlet, wherein the infrared heating element and the at least first heat exchanger are located between the blades and the outlet, wherein the gas enters the enclosure through the inlet to be received by the blades, and wherein the gas is moved by the blades to flow in the flow direction to exit the enclosure through the outlet.

6. The system of claim 5, further comprising at least a second heat exchanger positioned between the outlet and the infrared heating element.

7. The system of claim 1, wherein the at least first heat exchanger comprises walls that diverge from the tapered front toward a rear portion of the at least first heat exchanger that is oriented toward the infrared heating element.

8. The system of claim 1, wherein the at least first heat exchanger comprises a plurality of elongated members running approximately parallel with the flow direction, wherein the infrared heating element is located between the plurality of elongated members.

9. The system of claim 1, wherein the blades are curved and included in an impeller, the impeller being includable in a crossflow fan.

10. The system of claim 1, wherein the system further comprises an air filter.

11. An air circulating heater system comprising:

one or more blades to move a gas in a flow direction, the blades being rotatably repositionable;

an array comprising a plurality of infrared heating elements and a plurality of heat exchangers;

wherein each infrared heating element of the plurality of infrared heating elements is located near the blades, the gas flowing in the flow direction passing by at least part of the plurality of infrared heating elements, wherein each infrared heating element comprises a tube within which a wire or element may be positioned; and wherein each heat exchanger of the plurality of heat exchangers is positioned in a location in the flow direction approximately linearly between the blades and one infrared heating element of the plurality of infrared heating elements in an array, the at least first heat exchanger being at least partially tapered at a front portion and diverging toward a rear portion to direct the gas to minimize disruption of a flow pattern of the gas;

wherein the plurality of heat exchangers increases flow characteristics of the gas passed by the plurality of infrared heating elements; and wherein the plurality of infrared heating are selectable between heating and non-heating operation.

12. The system of claim 11, comprising a group of arrays, each array in the group being locatable substantially parallel to each other.

13. The system of claim 11, further comprising an enclosure with an inlet and outlet, wherein the array is located between the blades and the outlet, wherein the gas enters the enclosure through the inlet to be received by the blades, and wherein the gas is moved by the blades to flow in the flow direction to exit the enclosure through the outlet.

14. The system of claim 13, wherein the plurality of infrared heating elements in the array are arranged linearly in an orientation corresponding to the flow direction of the gas flowing away from the blades toward the outlet;

wherein the plurality of heat exchangers comprises:

at least a first heat exchanger positioned between the blades and an infrared heating element of the plurality of infrared heating elements that is nearest to the blades; and at least a second heat exchanger positioned between the outlet and an infrared heating element of the plurality of infrared heating elements that is nearest to the outlet.

15. The system of claim 11, wherein the blades are curved and included in an impeller, the impeller being includable in a crossflow fan.

16. A method of operating a heating system with high efficacy, the system comprising blades, an infrared heating element being selectable between heating and non-heating operation, and at least a first heat exchanger positioned in a location between the blades and the infrared heating element, wherein the infrared heating element comprises a tube within which a wire or element may be positioned, wherein the at least first heat exchanger comprises a tapered front oriented toward the blades to increase flow characteristics of a gas passed by the infrared heating element, the method comprising the steps of:

(a) moving a gas in a flow direction by rotating the blades;

(b) directing the gas using the heat exchanger to minimize disruption of a flow pattern of the gas; and (c) passing the gas across the infrared heating element located near the at least first heat exchanger with high flow characteristics, the gas being controllably heated by the infrared heating element.

17. The method of claim 16, wherein the system further comprises an enclosure with an inlet and outlet, the method further comprising the steps of:

(d) receiving the gas by the blades enclosure through the inlet; and (e) moving the gas using the blades to flow in the flow direction across the infrared heating element and the heat exchanger to exit the enclosure through the outlet.

18. The method of claim 17, wherein an array, comprised of a plurality of infrared heating elements and a plurality of heat exchangers, is located near the blades to minimize disruption of the flow pattern;

wherein the plurality of heating elements in the array are positioned substantially linearly in relation to the plurality of heat exchangers in the array.

19. The method of claim 17, wherein the system comprises a group of arrays, each array in the group being locatable substantially parallel to the other arrays in the group.

20. The method of claim 17, wherein the blades are curved and included in an impeller, the impeller being includable in a crossflow fan.

* * * * *